US011193336B2

(12) United States Patent
Ash et al.

(10) Patent No.: US 11,193,336 B2
(45) Date of Patent: Dec. 7, 2021

(54) DOWNHOLE CONNECTION

(71) Applicant: Reeves Wireline Technologies Limited, Leicestershire (GB)

(72) Inventors: Simon Christopher Ash, Nottinghamshire (GB); Neill Gilhooley, Nottingham (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 8 days.

(21) Appl. No.: 16/787,494

(22) Filed: Feb. 11, 2020

(65) Prior Publication Data

US 2020/0263506 A1 Aug. 20, 2020

(30) Foreign Application Priority Data

Feb. 15, 2019 (GB) ..... 1902141

(51) Int. Cl.

| | |
|---|---|
| ***E21B 17/02*** | (2006.01) |
| ***E21B 17/00*** | (2006.01) |
| *E21B 34/06* | (2006.01) |
| *E21B 47/12* | (2012.01) |
| *E21B 49/00* | (2006.01) |

(52) U.S. Cl.

CPC ..... *E21B 17/023* (2013.01); *E21B 17/003* (2013.01); *E21B 17/028* (2013.01); *E21B 17/0283* (2020.05); *E21B 34/066* (2013.01); *E21B 47/12* (2013.01); *E21B 49/00* (2013.01)

(58) Field of Classification Search

CPC .. E21B 17/028; E21B 17/003; E21B 17/0283; E21B 17/023

See application file for complete search history.

(56) References Cited

U.S. PATENT DOCUMENTS 3,753,206 A * 8/1973 Busuttil ..... E21B 17/028 439/194

3,829,814 A 8/1974 Straus (Continued)

FOREIGN PATENT DOCUMENTS

GB 2439426 A 12/2007

OTHER PUBLICATIONS

Search Report from counterpart UK Appl. GB1902141.9, dated Jun. 17, 2019, 1-pg.

*Primary Examiner* — D. Andrews

(74) *Attorney, Agent, or Firm* — Blank Rome LLP

(57) ABSTRACT

A downhole tool connection comprises (i) a tool intended for downhole use and including a connection section protruding therefrom in use in an uphole direction, the connection section supporting two or more first connectors spaced from one another and operatively connected to the tool; and (ii) a cable carrier moveable in an in-use downhole direction towards the connection section. The cable carrier supports (a) one or more cables and (b) two or more second connectors spaced from one another and operatively connected to at least one cable. Pairs of the first and second connectors are mutually connectable, on movement of the cable carrier towards the connection section to increase the proximity of the connectors of the pairs, in a manner effecting electrical transmission between the connectors of each pair. At least one pair of the connectors connects inductively, and at least one pair of the connectors connects conductively.

31 Claims, 4 Drawing Sheets

(56) References Cited

U.S. PATENT DOCUMENTS

| | | | | |
|---|---|---|---|---|
| 4,016,943 | A * | 4/1977 | Cullen | E21B 4/04 175/65 |
| 4,901,069 | A | 2/1990 | Veneruso | |
| 5,706,892 | A | 1/1998 | Aeschbacher | |
| 5,820,416 | A * | 10/1998 | Carmichael | E21B 17/028 439/668 |
| 6,360,820 | B1 | 3/2002 | Laborde | |
| 6,670,880 | B1 | 12/2003 | Hall | |
| 6,844,498 | B2 | 1/2005 | Hall | |
| 2001/0042617 | A1 | 11/2001 | Beck | |
| 2002/0193004 | A1 | 12/2002 | Boyle | |
| 2005/0070143 | A1 | 3/2005 | Eriksson | |
| 2005/0087368 | A1 | 4/2005 | Boyle | |
| 2006/0260797 | A1 | 11/2006 | Hall | |
| 2006/0260798 | A1 | 11/2006 | Hall | |
| 2007/0295504 | A1 | 12/2007 | Patel | |
| 2008/0012569 | A1 | 1/2008 | Hall | |
| 2008/0106433 | A1 | 5/2008 | Madhavan | |
| 2008/0251247 | A1 | 10/2008 | Flint | |
| 2009/0066535 | A1 | 3/2009 | Patel | |
| 2009/0098780 | A1 * | 4/2009 | Johansson | H01R 27/00 439/884 |
| 2010/0101786 | A1 * | 4/2010 | Lovell | E21B 17/028 166/250.01 |
| 2010/0182012 | A1 | 7/2010 | Harmon | |
| 2011/0057810 | A1 | 3/2011 | Partouche | |
| 2013/0186641 | A1 | 7/2013 | Lovell | |
| 2014/0008059 | A1 * | 1/2014 | Macrae | E21B 47/26 166/250.01 |
| 2017/0191321 | A1 | 7/2017 | Pike | |

* cited by examiner

DOWNHOLE CONNECTION

FIELD OF THE DISCLOSURE

The disclosure hereof relates to a downhole connection that is suitable for use in e.g. logging tools; testers such as but not limited to formation pressure testers; and tools or devices that sample fluids and/or gases, especially formation fluids and/or gases, in downhole situations. The disclosure is exemplified with reference to a logging tool connection but this is not to be construed as limiting.

Logging techniques are used extensively in the mining and oil/gas industries to help locate and/or assess the nature of formations containing various substances. Logging is also used when prospecting for e.g. underground water or when assessing features that may affect the stability, strength, hardness, porosity or other parameters of rock. Such assessments are beneficial when preparing to recover hydrocarbons, water and minerals, or when preparing for tunneling or construction work. The last-mentioned may relate to the creation of above-ground or subterranean structures the latter including but not being limited to underground storage facilities.

Testing and sampling are similarly broadly applicable activities.

The invention is of utility in all such endeavors.

BACKGROUND OF THE DISCLOSURE

As is well known, prospecting for minerals of commercial or other value (including but not limited to hydrocarbons in liquid or gaseous form; water e.g. in aquifers; and various solids used e.g. as fuels, ores or in manufacturing), assessing rock properties, testing and sampling as aforesaid are economically and technically important and challenging activities. For various reasons those wishing to extract minerals and other substances from below the surface of the ground or beneath the floor of an ocean need to acquire as much information as possible about both the potential commercial worth of the minerals in a geological formation and also any difficulties that may arise in the extraction of the minerals to surface locations at which they may be used. Those wishing to assess the strength, stability, etc. of rock have comparable information needs.

For these and related reasons over many decades techniques of logging of subterranean formations have developed for the purpose of establishing, with as much accuracy as possible, information about subterranean conditions. Logging also is used for other purposes as summarized above.

Most prior art logging techniques involve the emission of energy into the rock of interest, that has been penetrated by e.g. a borehole, using a transmitter forming part of an elongate logging tool. In prior art logging tools detection of energy that has passed through the rock then takes place using one or more receivers at locations along the logging tool that are spaced from the transmitter. The aim of such an arrangement is to try and detect only the energy that has passed through the rock, and not energy adopting transmission paths that avoid the rock or only minimally penetrate it. Changes in the detected energy may then be interpreted to provide values of physical quantities that are indicative of various properties of and conditions in the rock.

In use of most known designs of logging tool the tool is conveyed to a particular depth along the borehole, which may be at or near its "total depth" (i.e. the furthest downhole extremity along the borehole from the surface location at which the borehole terminates at its uphole end) but this need not be so and the logging tool can be usefully conveyed to in practice any depth along the borehole as desired. The tool in use is drawn from such a downhole location towards the surface termination of the borehole. The logging tool records or transmits (to an uphole location) log data at a series of logging depths on its travel along the borehole. Depending on the exact style of logging under consideration, logging may take place either when the logging tool is moving in a downhole direction, or when it is moving in an uphole direction. The invention as defined herein is not limited to any particular direction of movement or mode of conveyance of the logging tool.

As used herein "logging depth" refers to the location along the borehole, measured from the uphole end, at which a particular logging activity takes place. Most logging tools (or apparatuses associated with them) are able to record or indicate the depth along the borehole at which each logging action occurs, and this information is included in data logs when these are created, transmitted, recorded, stored, printed or plotted for viewing. A logging tool may detect and record/transmit many hundreds or thousands of data sets during its travel along the borehole and usually it is important to identify the location in the borehole at which each batch of data is acquired.

Although extensive reference is made herein to "depth" as a measure of distance along a borehole, it should be understood that boreholes drilled or otherwise formed in rock for purposes such as logging, mineral recovery, water recovery, hydrocarbon recovery and rock property evaluations do not necessarily extend entirely or even (in some cases) appreciably vertically. Thus the terms "logging depth" and derivatives include measures of distance along a borehole, in general.

Terms such as "depth of penetration", "depth of investigation" and derivatives, in contrast, refer to the distance from a borehole into the rock over which a particular log contains useful information about the rock. Thus in the case of a prior art energy-emitting logging tool having spaced receivers for receiving transmitted energy, the depth of penetration is a measure of the extent to which the emitted energy spreads into the rock before returning to the receiver section of the logging tool.

The terms "uphole", "downhole" and derivatives are familiar to those of skill in the borehole logging art and do not require further explanation herein.

The need in logging to energize the rock surrounding a borehole and the need to transmit or telemeter log data signals from the logging tool to an uphole location create particular difficulties with respect to the making and breaking of electrical connections in downhole environments ("making" and "breaking" of electrical connections being familiar concepts to the person of skill in the art).

Furthermore in addition to the energy provision and data signal transmission requirements a need often arises in logging to provide control signals for controlling the logging tool e.g. in terms of deployment of deployable parts of the tool, the commencement of data recording or transmitting activity, the termination of such activity, signaling completion of a task and so on; and these actions also give rise to a need for electrical connections to be made and broken as required in downhole locations.

Frequently there is a need to transmit high levels of electrical power to the logging tool, in order to power e.g. an energy generator such as but not limited to a current-generating circuit used in a resistivity logging tool or a pulsed source in a neutron generator tool type and/or in order to cause deployment of parts of the logging tool from retracted to deployed configurations. On the other hand the data telemetry, command signaling and similar signals usually require a lower electrical power than the energizing signals.

It is well known to use wireline (i.e. a form of armored electrical cable that is capable of supporting a logging tool while conveying electrical power, data and control signals uphole and downhole as required) for electrical power and signal transmission purposes such as those outlined above. However for various reasons that are familiar to the person of skill in the art it is also often the case that conveyance of the logging tool to a downhole location must occur with the tool disconnected from wireline. This is a frequent cause of requirements to make and break electrical connections when the logging tool is downhole.

In other words there often arises a need to connect wireline to a logging tool after the latter has been deployed in a borehole. In the prior art this is often attempted through use of a type of connector sometimes called a "wet connector". This typically is constituted by plug and socket connector parts one of which is located on the logging tool and the other of which is permanently connected to wireline. When a downhole connection is required the wireline and connector part are introduced into the downhole vicinity of the logging tool from an uphole location often using a further tool, such as a "pump-down" device, that may adopt any of a variety of designs. This causes the plug connector part to become inserted into the socket, whereupon mutually engageable electrical connector parts contact one another in order to "make" an electrical conduction path between them.

The environment within a borehole however is usually extremely harsh, in terms of temperature, vibration, debris, and chemical aggressiveness and/or electrical conductivity of borehole fluids. These factors make it hard to ensure reliable connection together of the wet connector sections; they can give rise to short circuits via unintended electrical conduction paths; and moreover they shorten the service lives of the connector components typically through premature abrasion or wear or through chemical attack.

Also there usually is limited space for accommodating wet connector parts and the borehole is unlikely to be symmetrical, with the result that the logging tool rarely is centered in the borehole in a manner permitting accurate alignment of the connector parts. Consequently wet connectors do not always achieve the connection reliability that is demanded in oilfield exploration and production environments. Furthermore they sometimes can connect in an electrically unpredictable manner when the borehole fluid is highly conductive.

For reasons such as the foregoing there exists a need for a downhole connector design that offers improvements over the prior art.

SUMMARY OF THE DISCLOSURE

Testing and sampling tools used in downhole environments may not be required to energize rock in the same ways as logging tools but they may nonetheless have similar energy input requirements to logging tools. Such tools moreover may be required to telemeter e.g. output (log) signals to surface locations.

For such reasons sampling and testing tools and subs frequently are connected to surface locations using wireline. Requirements to convey such tools disconnected from wireline until it is desired to transmit power and/or signals between the tools and surface locations gives rise to connector "make" and "break" operations in a similar way as for logging tools.

As noted embodiments described herein are applicable at least to all the downhole tool or sub types referred to. References to "downhole tools" and derivatives include but are not limited to such tools and/or subs; and especially logging tools, downhole testers and downhole sampling tools. The concept of a sub is familiar to the person of skill in the art. The disclosure of embodiments herein extends both to subs and to entire tools. Embodiments described as being implemented in tools are capable of implementation in subs and vice versa, subject as necessary to modification as would occur to the person of skill in the art.

Disclosed herein in a broad aspect is a downhole tool connection comprising (i) a tool intended for downhole use and including a connection section protruding therefrom in use in an uphole direction, the connection section supporting two or more first connectors that are spaced from one another and operatively connected to the tool; and (ii) a cable carrier that is moveable in an in use downhole direction towards the connection section, the cable carrier supporting (a) one or more cables and (b) two or more second connectors that are spaced from one another and operatively connected to at least one said cable, pairs of the first and second connectors being mutually connectable, on movement of the cable carrier towards the tool connection section so as to increase the proximity of the connectors of the pairs, in a manner effecting electrical transmission between the connectors of each pair, wherein at least one pair of the connectors connects inductively and at least one pair of the connectors connects conductively.

The use of pairs of connectors that respectively connect inductively and conductively provides several advantages of the connection of embodiments hereof over the prior art.

The inductive connector pair(s) can be employed for relatively low power connections between the wireline and the tool, as may be required for electrical conduction paths conveying control commands from an uphole location to the tool and/or for the conveyance of log or other data signals from the tool to an uphole location.

Such connectors can be arranged to pass a relatively low power signal that may be e.g. about 8-9 Watts, although this power range is not to be construed as limiting. Using an inductive connector means that such signals reliably can be transmitted between the wireline and the tool without the problems of conductive borehole fluids interfering with the connection in the ways outlined above. The use of inductive connector parts for this purpose moreover avoids the need for physical contact between the parts. As a result the degradation of the connector parts caused by abrasive components of the borehole environment may be prevented.

A further benefit of using inductive connector parts is that they can be shielded against chemical attack without appreciable detriment to their connection ability.

As is implied by the foregoing, "connection" and derivative terms as used herein are not limited to arrangements in which physical contact of connector parts is required; and indeed an important aspect of the invention is that at least one pair of connectors connects inductively, i.e. without contact.

The downhole tool connection of embodiments disclosed herein also includes at least one pair of connector parts that connect together in a manner permitting conduction of electrical current. Such connector parts can be used to convey higher levels of electrical power than the inductive connector pair(s), so they are useful for passing operational electrical power to the tool from an uphole location. Such operational power chiefly is useable to power an energy source in the tool when it is or includes a logging device that operates by energizing rock surrounding a borehole; and to energize various electrical, electronic and computing parts of the tool. Additionally or alternatively it may be used to cause deployment of retracted tool parts and/or retraction of deployed tool parts, or similar effects.

The conducting connector parts can beneficially be located on the connection section and the cable carrier respectively in a manner advantageously shielding them from most if not all of the aforementioned adverse features of the downhole environment. Means for assisting to shield the conducting connector parts are further described below.

In embodiments described herein preferably the connection section is or includes an elongate mandrel protruding from the in-use uphole end of the logging tool.

This arrangement is advantageous because the mandrel may be arranged to define a plug that is incapable of becoming filled or clogged with borehole fluid.

The cable carrier in such an embodiment can be arranged as a socket including means preventing the ingress of borehole fluid. An advantageous way of achieving this benefit is described herein.

However the invention is not limited to arrangements in which the connection section is constituted as a mandrel defining a plug; and this component could instead be constituted as a socket if desired.

When the connection portion is configured as a protruding mandrel as explained, preferably the downhole tool connection includes a plurality of first connectors defining a series extending along the elongate mandrel. Further preferably at least one first connector of the series that lies nearest the tool connects inductively and at least one first connector that lies furthest from the tool connects conductively.

In practical embodiments described herein the downhole tool connection includes a plurality of first connectors that connect inductively defining a first series extending along the elongate mandrel away from the tool; and a plurality of first connectors that connect conductively defining a second series extending along the elongate mandrel away from the first series.

The foregoing arrangements advantageously assist in ensuring reliability of the downhole tool connection when it is "made". Further explanation of this benefit is provided herein.

In one embodiment the first series comprises six first connectors and the second series comprises two first connectors. Other numbers of the first and second connectors however are also possible and are disclosed hereby.

Conveniently at least one first connector encircles the mandrel. This aspect also assists in ensuring reliability of the electrical connection.

In an embodiment described herein the cable carrier includes one or more socket for receiving the connection section therein. This permits the optional provision of a semi-solid, essentially non-conducting medium occupying the cross-section of the interior of the socket at least in the vicinity of a connector that connects conductively. In embodiments the semi-solid medium is a non-conducting grease, although other forms of semi-solid medium are possible.

Regardless of its precise form the semi-solid medium advantageously assists in preventing the ingress of borehole fluid into the socket while the latter is downhole. The semi-solid medium is wiped from the conductive connector in question, when connection occurs, by reason of the contact between connector parts that is needed to effect conductive connection. As a result the non-conductive nature of the semi-solid medium does not impede the formation of a conductive connection when this is required but it does prevent the ingress of potentially conductive borehole fluids at other times.

Optionally the socket is or includes an elongate hollow cylinder. Further optionally at least one of the second connectors includes an annulus extending about the interior of the hollow cylinder.

These aspects of the form of the cable carrier assist in the presentation of the mentioned series of connectors in register with the connectors of a connection section as defined above when the latter is received in the socket.

Conveniently the diameter of a said second connector including an annulus extending about the interior of the hollow cylinder that connects inductively is greater than the outer diameter of the first connector of the pair of which the second connector forms part. This permits the first connectors to connect inductively, without any requirement for contact between them.

Also conveniently the diameter of a said second connector including an annulus extending about the interior of the hollow cylinder that connects conductively results in contact with the first connector of the pair of which the said second connector forms part when the said first and second connectors are in proximity. This promotes conductive contact of the connectors in question, and also assists with wiping of the connectors. A wiping effect is beneficial when the semi-solid medium mentioned above is present in the socket; and also at times when the semi-solid medium is not provided.

Preferably the downhole logging tool connection includes a plurality of the second connectors defining a series extending along the interior of the socket. In embodiments described herein the elements of the series of second connectors correspond in number and location to the series of first connectors, when the connection section and the cable carrier are brought into proximity with one another as described herein. Thus on connection of the two principal parts of the downhole tool connector together the first and second connectors may be brought in register with one another in power-transmitting pairs.

Consistent with the desirability of bringing the first and second connectors in register in pairs, preferably at least one second connector of the series that in use lies nearest the logging tool connects inductively and at least one second connector that lies furthest from the logging tool connects conductively. Thus the arrangement of the connectors in the socket may mirror the arrangement of the conductors supported by the connection section.

Further to this end, optionally a plurality of second connectors that connect inductively define a third series extending in use along the interior of the socket away from the logging tool; and a plurality of second connectors that connect conductively define a fourth series extending along the interior of the socket away from the first series.

Conveniently the cable carrier includes an elongate, cylindrical body supporting on its exterior one or more swab cups permitting pumping of the cable carrier along a borehole.

Swab cups are known per se and are useful in the downhole tool industry for effecting conveyance of tools along a borehole under the influence of pumped borehole fluid.

Also conveniently the cable carrier optionally includes an elongate, hollow cylindrical body inside which at least one cable supported by the cable carrier extends. As a result the cable, connection of which in downhole location to a tool is required, is protected against the downhole environment.

In embodiments described herein one or more flexible weights support at least one said cable inside the cylindrical body. In more detail an optional weight bar provided in embodiments described herein adds mass to a downhole tool to assist in running into the wellbore. Making the weight flexible (bendable along its longitudinal axis) makes traversal of any partial obstructions in the bore of the pipe (borehole, wellbore, etc.) easier.

Preferably at least one cable supported by the cable carrier in use connects to one or more sources of electrical power located uphole of the tool. As a result electrical power may be transmitted to the tool in a downhole location. One preferred form of cable is a twisted cable pair. Such a cable design beneficially inhibits crosstalk between the elements of the cable pair.

In more detail, preferably at least one cable supported by the cable carrier that connects to a said second connector that connects inductively is connected to one or more sources of electrical power in an approximate range of 8-15 Watts per cable, although this power range is not to be construed as limiting.

On the other hand at least one cable supported by the cable carrier that connects to a said second connector that connects conductively may be connected to one or more sources of electrical power in an approximate range centered on 200 Watts when connected singly and more when connected in parallel. The indicated power ranges are not to be construed as limiting. In one embodiment the power rating of the power source is at least 200 Watts.

Further in detail, optionally the cable carrier is or includes a side entry cable sub allowing the cable to traverse from the outside to the inside of the drill pipe via an orifice that is sealable against downhole fluid pressure.

As is familiar to the person of skill in the art, the term "sub" refers to any of a variety of subcomponents of a downhole tool or device; and a side entry cable sub is known per se in the downhole tool art.

Embodiments of the downhole tool connector described herein may include one or more shock absorber acting between the connection section and the tool.

In this regard some tools, including various logging tools, are heavy, elongate assemblies of parts that can weigh several hundreds or thousands of kilograms. As a non-limiting example in this regard some designs of reservoir evaluation tool can weigh in excess of 2500 kg. In light of this it is beneficial to provide shock absorption features in a downhole tool connection in which parts of this category of weight may be moved into proximity with one another.

In embodiments the shock absorber optionally includes one or more resiliently deformable member defining an elongate column whereby the column is resiliently compressible on being subjected to compressive force in the direction of elongation of the column. Other designs of shock absorber however are possible and will occur to the person of skill in the art.

Further optionally the or each resiliently deformable member is formed as two or more regions of the material or materials of the column that are interconnected by resiliently deformable interconnecting elements; and at least one of the resiliently deformable interconnecting elements may be formed from the material or materials of the column.

Regardless of the precise design of its resiliently deformable parts, preferably the shock absorber includes at an in-use uphole end one or more landing surfaces from which the connection section protrudes in a manner exposing part of the landing surface for engagement by the cable carrier on movement of the cable carrier towards the tool connection section so as to increase the proximity of the connectors of the pairs.

In such an arrangement the connection section optionally may include a cylindrical body that defines the landing surface and includes one or more fluid flow passage extending therethrough and defining a fluid flow path.

Such a fluid flow path is advantageous since the cable carrier on moving into proximity with the connection section forces borehole fluid ahead of itself. The fluid flow passage avoids an undesirable build-up of fluid pressure acting on the landing surface.

The fluid flow path may include one or more openable and closeable valves for opening and closing the fluid flow path. This optional feature permits, in particular, closing of the fluid flow path e.g. when the borehole "kicks" (i.e. suffers an unexpected, large pressure pulse in the downhole borehole fluid). The presence of a closeable valve can prevent damage caused by pressure kicking to parts of the logging tool connection that are uphole of the valve.

The valve can be arranged to be normally open, and closeable under the influence of a rapid fluid pressure increase as is characteristic of pressure kicking.

The disclosure hereof includes a downhole tool connection as defined herein when included in or forming part of a logging tool, a tester or a sampling tool. The disclosure extends to logging tools, testers and/or sampling tools including one or more downhole connectors as described and/or claimed herein.

BRIEF DESCRIPTION OF THE DRAWINGS

There now follows a description of a preferred embodiment, by way of non-limiting example, with reference to the accompanying drawings in which.

DETAILED DESCRIPTION

Figure 1A:
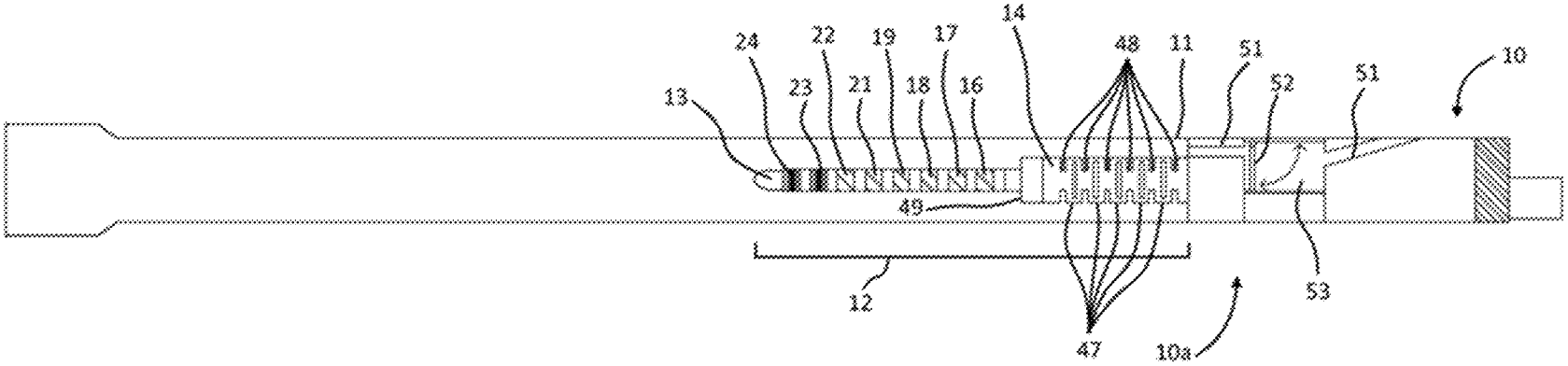
FIG. 1*a* illustrates a logging tool inside drill pipe and having a protruding connection section.

Referring to the drawings a logging tool 10 intended for downhole use is illustrated in a downhole location in a borehole secured at the end of drill pipe 11. The nature of drill pipe is well known in the downhole exploration discipline and is not described in full herein.

The logging tool 10 may take any of a wide variety of forms and non-limitingly may be e.g. a resistivity logging tool or a pulsed neutron generator type, these logging tools being illustrative of kinds of logging tool that have mixed electrical power requirements. In particular such logging tools require a high power connection that powers an energy source forming part of the logging tool that energizes a rock formation surrounding the borehole; and they also have one or more relatively low power needs for purposes of telemetering log data to a surface (uphole) location, transmission of deployment and activation commends from the surface location to the logging tool and so on as indicated herein.

It is known to deploy logging tools such as logging tool 10 protruding from the end of drill pipe 11 that is fed into the borehole from the surface location. Drill pipe is manufactured in discrete lengths that may be connected one to another at the surface location and that when connected together in short lengths are called "stands". The addition of drill pipe stands one by one in this way repeatedly extends the resulting drill pipe string into the borehole until the protruding logging tool reaches a depth in the borehole at which logging is to commence.

Subsequent logging takes place typically while the stands or the individual lengths of drill pipe one by one are removed from the uphole end of the drill pipe string, with the consequence that the logging tool is gradually withdrawn along the borehole in an uphole direction.

Many logging tool designs must be connected to wireline so that (a) power for energizing the rock can be transmitted to the downhole logging tool; (b) deployment, activation and other commands can be transmitted to the logging tool; (c) the logging tool can transmit signals to an uphole location in order to indicate its status, correct or incorrect deployment, the start and finish of logging activities and so on; and (d) log data signals generated by the logging tool can be telemetered to an uphole location for processing, analysis, display, storing, printing and transmitting purposes.

It is however in many instances impossible to deploy the logging tool protruding from the drill pipe with the wireline connected. Therefore it is necessary to arrange connection of the wireline to the logging tool after the latter has been deployed to the depth in the borehole at which logging is to commence. As explained, prior art arrangements for effecting such connection are in various ways sub-optimal.

The logging tool 10 of FIG. 1*a* includes protruding from its in-use uphole end 10*a* in an uphole direction a connection section 12 that forms one element of a downhole logging tool connection according to the disclosure hereof.

The connection section 12 in the illustrated embodiment includes an elongate mandrel 13 that protrudes from a shock absorber 14, that is described in more detail below, forming a further part of the connection section 12 and interconnecting the mandrel 13 and the uphole end 10*a* of the logging tool 10.

Mandrel 13 is in the illustrated embodiment a rigid, elongate cylindrical member. Such an element is relatively easy to manufacture and its shape promotes good connection with a cable carrier 26 described below. However other forms of the connection section 12 may include e.g. mandrels of non-circular cross-section (such as but not limited to ellipses, regular polygonal shapes or irregular polygonal shapes). Partly hollow or perforated members also are possible, as are many further design variants of kinds that will occur to the person of skill in the art. The mandrel 13 does not have to be of constant or regular cross-section, although a circular cross-section is preferred.

The mandrel 13 supports a plurality of first electrical connectors 16, 17, 18, 19, 21, 22, 23, 24. These are presented as a series of mutually equally spaced elements extending in a line along the mandrel 13.

As explained in more detail below, first connectors 16, 17, 18, 19, 21 and 22 are relatively low power connectors (e.g. that non-limitingly are designed to transmit 8-15 Watts each) that connect inductively; and first connectors 23, 24 are relatively high power connectors (e.g. intended to transmit 200+ Watts each) that connect conductively.

Each of the first connectors 16, 17, 18, 19, 21, 22, 23, 24 is formed as an annulus that is secured to and encircles the shaft of the mandrel 13. Each of them is insulated from the material of the mandrel 13 and is connected e.g. inside the mandrel 13 to at least one cable that electrically communicates with one or more operative parts of the logging tool. The person of skill in the art readily will be able to envisage such insulation and cable connections inside the mandrel 13.

Other forms and numbers of the first connectors 16, 17, 18, 19, 21, 22, 23, 24 are possible within the scope of this disclosure. Thus for example it is not essential that the first connectors 16, 17, 18, 19, 21, 22, 23, 24 in each, or indeed any, case encircle the mandrel 13 and instead for instance one or more of them may be formed as interrupted annuli, strips, buttons or blocks. As indicated the numbers of first connectors 16, 17, 18, 19, 21, 22, 23, 24 may differ from the eight illustrated; and it is not essential that the spacings between each adjacent pair of first connectors is the same as described. Combinations of different first connector types are possible within the scope of the disclosure.

The downhole logging tool connection also includes a cable carrier 26 supporting one or more cables 27 and a plurality of second connectors 28, 29, 31, 32, 33, 34, 36, 37.

The cable carrier 26 is intended for deployment inside the drill pipe 11 in a manner described below and includes at an in-use downhole end an elongate, hollow cylindrical socket 38 that is open at an in-use downhole end and closed at its opposite end as illustrated. As described in more detail below socket 38 is in use of the downhole logging tool connection located and dimensioned to receive inserted therein the mandrel 13.

The second connectors 28, 29, 31, 32, 33, 34, 36, 37 are located in a series extending along the inside of the socket 38.

Each second connector 28, 29, 31, 32, 33, 34, 36, 37 is in the illustrated embodiment an annulus extending about the circular cross-section interior of the socket 38; but this need not necessarily be the case. Thus for example it is not essential that the second connectors 28, 29, 31, 32, 33, 34, 36, 37 in each, or indeed any, case encircle the mandrel 13 and instead for instance one or more of them may be formed as interrupted annuli, strips, buttons or blocks. The numbers of second connectors 28, 29, 31, 32, 33, 34, 36, 37 may differ from the eight illustrated; and it is not essential that the spacings between adjacent pairs of second connectors is the same as described. Combinations of different second connector types are possible within the scope of the disclosure.

Figure 1B:
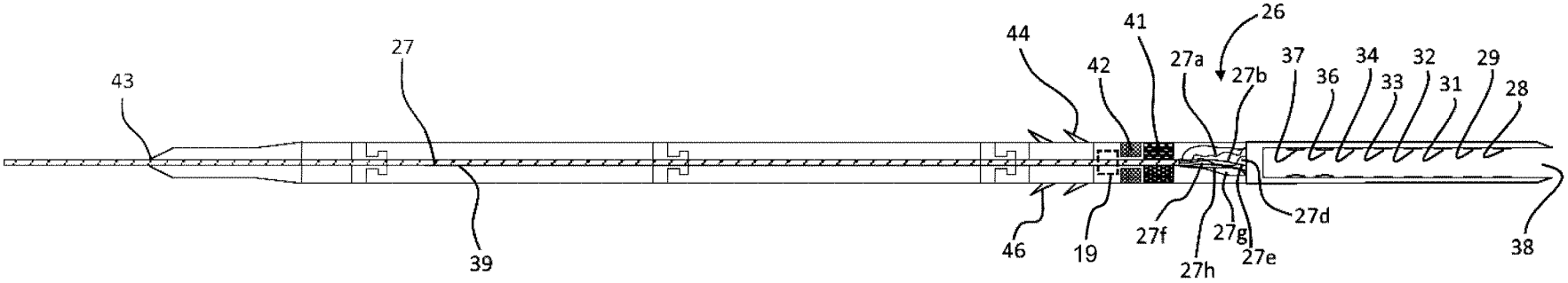
FIG. 1*b* illustrates a cable carrier supporting one or more cables for movement inside the drill pipe in a manner permitting connection to the connection section.

In like manner to the mandrel 13 it is not essential that socket 38 exhibits the regular, circular cross section illustrated in FIG. 1*b*. Thus it is possible for the socket 38 to have a non-circular and/or irregular cross-section, for example adopting one or more of the shapes listed above in relation to the mandrel 13. When the downhole logging tool connection is embodied in a form as illustrated including a mandrel 13 and socket 38 however it is important that the dimensions and/or shapes of these parts are such as to permit the insertion of the mandrel 13 into the socket 38 in a manner promoting electrical connection between the respective first 16, 17, 18, 19, 21, 22, 23, 24 and second 28, 29, 31, 32, 33, 34, 36, 37 connectors.

To this end in the embodiment of FIGS. 1*a* and 1*b* the locations, diameters and spacings of the second connectors 28, 29, 31, 32, 33, 34, 36, 37 are such that on insertion of the mandrel 13 into the socket 38 as described below each respective first connector 16, 17, 18, 19, 21, 22, 23, 24 is in register with an associated second connector 28, 29, 31, 32, 33, 34, 36, 37.

In a similar manner to the series of first connectors 16, 17, 18, 19, 21, 22, 23, 24, the second connectors 28, 29, 31, 32, 33, 34 are relatively low power connectors that connect inductively and the second connectors 36, 37 are relatively high power connectors that connect conductively.

As is apparent from the figures the six first conductors 16, 17, 18, 19, 21, 22 supported on the mandrel 13 closest to the logging tool 10 connect inductively and the two first conductors 23, 24 furthest from the logging tool 10 connect conductively. The second connectors 28, 29, 31, 32, 33, 34, 36, 37 are similarly arranged so that on insertion of the mandrel 13 into the socket 38 each inductive first connector is in register with an inductive second connector; and each conductive first connector is in register with a conductive second connector. Thus, overall, there are four series of connectors: two made up of first connectors supported on the mandrel and consisting respectively of inductive and conductive connectors; and two supported in the socket and also consisting respectively of inductive and conductive connectors.

The cable 27 is in the illustrated embodiment non-limitingly shown as wireline the nature and characteristics of which are well known in the logging tool art. The design of the cable 27 therefore is not described in detail herein, except to note that within an outer, armored, semi-rigid casing 39 the wireline is constituted as a plurality of individual cables some of which are relatively high-power cables and some of which are relatively low-power cables.

As shown in FIG. 1*a* the individual cables 27*a*-27*h* extend beyond the termination of the armored casing 39 inside the cable carrier 26 uphole of the closed end of the socket 38. The individual cables 27*a*-27*h* connect respectively to the second connectors 28, 29, 31, 32, 33, 34, 36, 37 by passing along passages formed in the material of the socket 38. The armored casing 39 is clamped in one or more clamping blocks 41, 42 inside the cable carrier 26 in order to stabilize the wireline at the end of the armored casing 39.

In FIG. 1*b* the individual cables are illustrated as being the same as one another but in embodiments it is likely that at least the individual cables intended to carry relatively high currents will be of differing specifications and designs than individual cables intended to carry relatively low currents. In the illustrated embodiment six of the individual cables 27*a*-27*f* are low power cables and are connected to the respective inductively connectable second connectors 28, 29, 31, 32, 33, 34; and two of the individual cables 27*g* and 27*h* are relatively high-power cables that connected to the conductively connectable second connectors 36, 37.

More or fewer of the relatively low-power and relatively high power individual cables may be provided, depending on the nature of the logging tool 10 and its operational requirements. The numbers of first connectors correspond to the numbers of second connectors that are in turn determined by the number and nature of individual cables.

At least one of the individual cables 27*a*-27*h* is in use of the downhole connection connected at an uphole or surface location to a source of electrical power. At least a pair of the individual cables 27*a*-27*h* may be provided as a twisted cable pair.

The cable carrier 26 extends as a plain cylindrical body in an uphole direction for several meters and encloses the wireline over this length extending along the cable carrier 26 within a hollow interior. The wireline 27 enters the interior of the cable carrier by way of an aperture 43 formed in the uphole end of the cable carrier. A side entry sub, i.e. a separate sub placed higher in the drill string to allow the cable to enter the inside of the drill pipe may be provided in order to permit the cable 27 to enter the illustrated tool string at a relatively uphole location. Side entry sub designs are familiar to the person of skill in the art. Separately a female pump down/weight bar assembly may be provided on the end of the wireline (cable 27). For example, this may take the form of one or more flexible weights 19 supporting at least one of the one or more cables inside the cylindrical body, a possible location for which is schematically illustrated in FIG. 1*b*.

The interior of the socket 38 in a typical use application would be filled with a semi-solid, non-conducting medium such as a grease. This prevents the ingress of borehole fluid into the interior of the socket 38 during deployment of the cable carrier from an uphole location. The precise specification of the grease may be selected by the person of skill in the art depending on the nature of e.g. the borehole fluid.

In practice it is relatively straightforward to fill the entire socket with the semi-solid medium, but the disclosure also includes within its scope arrangements in which the socket is partially filled with such a medium, or empty of medium.

Each of the second connectors 28, 29, 31, 32, 33, 34 that connects inductively is of a greater diameter than that of the respective first connector 16, 17, 18, 19, 21, 22 with which it is in register on insertion of the mandrel 13 into the socket 38. Thus the inductively connectable second connectors 28, 29, 31, 32, 33, 34 and the inductively connectable first connectors 16, 17, 18, 19, 21, 22 pass one another essentially without contact during movement of the connection section 12 and the socket 38 from a position of relative separation downhole to a position of greater proximity that brings the respective first and second connectors into register with one another.

This minimizes the effect of the first and second connectors abrading one another, or causing abrasion by reason of the trapping of borehole fluid between the inductively connectable first and second connectors.

Moreover since the first and second inductively connectable connectors do not need to contact one another in order for an electrical connection to be made, they can be protected (e.g. through the application of polymeric or other durable covers or coatings that prevent or at least minimize abrasion and chemical attack by the borehole fluid).

On the other hand the diameter of each of the second connectors 36, 37 that connect conductively are such as to contact the exterior of the first, conductively connectable connector 23 or 24 with which it is in register when the mandrel 13 is fully inserted into the socket 38. This gives rise to the conductive connection and also causes wiping of the conductively connectable connectors in a manner removing grease, borehole fluid and other media that might otherwise interfere with the conductive connection.

The cylindrical exterior of the cable carrier 26 includes encircling it at least one, and in the illustrated embodiment two, swab cups 44, 46.

A swab cup is known per se in the downhole tool deployment art and typically consists of a circular or annular cup-like structure formed of a resiliently deformable material. In the case of the illustrated embodiment the exterior diameter of the cup is such that the resiliently deformable material of the swab cup 44, 46 seals against the inner surface of drill pipe 11 inside which the swab cup 44, 46 is deployed. An inner annulus of the swab cup seals on to the exterior of the cable carrier 26.

As a result of this arrangement when borehole fluid is circulated by pumping in the drill pipe 11 it is possible to convey the cable carrier along the interior of the drill pipe 11. This is known as "pump down" deployment, and is familiar to the person of skill in the art.

The connection section 12 includes a shock absorber 14 extending between the mandrel 13 and the logging tool 10. The shock absorber 14 in the illustrated embodiment is constituted as a collapsible column defined by a series of resiliently deformable elements 47 seriatim interconnecting respective, intermediate incompressible members 48 that may be formed e.g. as discs of rigid material. In the illustrated embodiment the resiliently deformable elements 47 and the incompressible members 48 are formed by machining or other material removal methods from an initially solid column of a rigid material such as a metal. However a variety of other ways of forming the shock absorber are possible and the disclosure is not limited to the arrangement shown. As one non-limiting variant one may consider a stack of resiliently deformable (e.g. polymeric) tubes.

The uphole end of the shock absorber 14 adjacent the downhole end of the mandrel 13 is formed as a disc-like landing surface 49. The landing surface is dimensioned to be engageable by the open end of the socket 38 on insertion of the mandrel 13 thereinto. The lengths of the mandrel 13 and the socket 38 are chosen to permit such engagement without the end 13*a* of the mandrel engaging the closed end of the socket 38.

A fluid flow passage 51 is formed in the material of the logging tool 10 in a manner interconnecting the uphole side of the logging tool 10 and its downhole side that protrudes downhole beyond the drill pipe 11. As a result the fluid flow passage 51 defines a fluid bypass allowing fluid under pressure inside the drill pipe 11 to escape in a downhole direction.

The fluid flow passage 51 includes a valve 52. This may take a variety of forms and in the illustrated embodiment is a spring-loaded flapper valve formed in a valve chamber 53 of greater dimensions than the passage 51.

The spring loading of the flapper valve 52 maintains it in a normally closed position blocking the flow of fluid in the passage 51. When the pressure of fluid in the passage 51 is sufficient to overcome the biasing of the flapper valve 52 the valve opens and permits fluid bypass.

The biasing of the valve 52 to a normally closed position means that in the event of well kicking causing a pressure pulse that travels in an uphole direction (typically at high speed) the valve prevents transmission of pressure-induced forces uphole that might damage equipment or cause injury to operators in the vicinity of the borehole. Biasing of the flapper valve 52 may be effected in a per se known way using one or more springs or in a variety of alternative ways.

In use of the illustrated downhole connection the logging tool 10 is initially secured onto the downhole end of a stand of drill pipe 11 that is then fed from an uphole (surface) location in to a borehole. Successive drill pipe stands are then added at the uphole location, thereby progressively lengthening the drill pipe string with the logging tool protruding from its downhole end.

During this process the logging tool 10 must remain disconnected from wireline and is depowered.

When the logging tool 10 reaches a location at which logging is to commence the cable carrier 26, supporting the wireline 27 as described and having its socket 38 filled with non-conducting grease also as described, is pumped down the borehole inside the drill pipe 11. Such pumping is effected by circulating borehole fluid in the drill pipe, using per se known pumping and valve control techniques to cause the swab cups 44, 46 to drive the cable carrier 26 in a downhole direction. During this process pressurized borehole fluid driven ahead of the cable carrier 26 passes via the passage 51 to open valve 52 and vent to the downhole side of the drill pipe 11.

Figure 2:
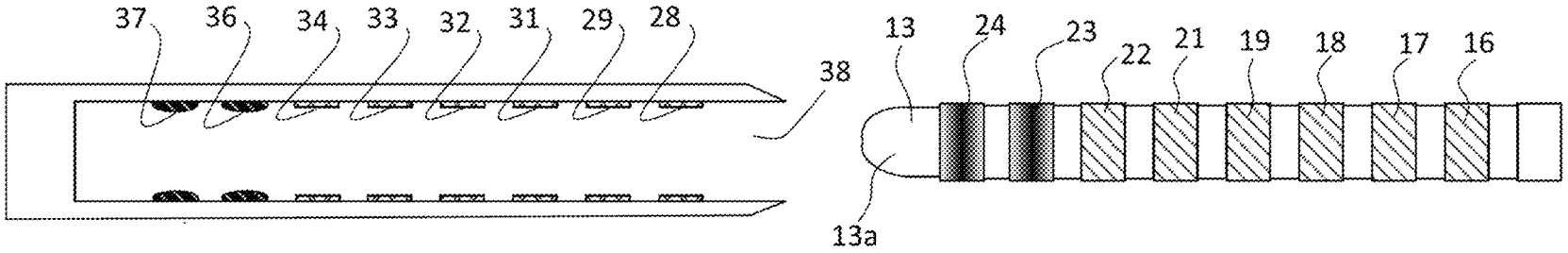
FIG. 2 is an enlargement of part of the connection section of FIG. 1*a* and the cable carrier of FIG. 1*b* when they are spaced from one another inside drill pipe such that connection between them is not established.

The relative positions of the mandrel 13 and the socket 38 just before making of the required downhole connections occurs is shown in FIG. 2. The dimensions and shape of (a) the open end of the socket 38 and (b) the end 13*a* of the mandrel 13 are such that as long as the cable carrier 26 is largely centered in the drill pipe (as would be assured through appropriate swab cup design) the mandrel 13 is aligned for entry into the socket 38.

Figure 3:
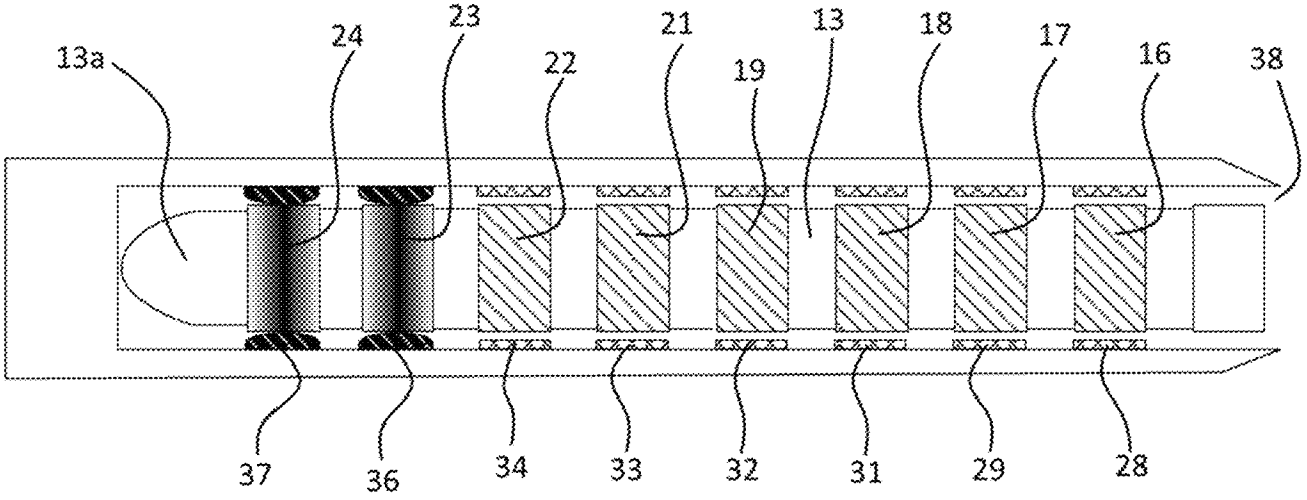
FIG. 3 shows the parts of FIG. 2 following movement together of the connection section part and the cable carrier part to a state of increased proximity amounting to connection between the connection part and the cable carrier part.

Further pumping of the cable carrier 26 in a downhole direction results in the situation shown in FIG. 3, in which the mandrel is fully inserted into the socket 38. As the insertion completes the various pairs of connectors align with one another to form the described inductive or conductive connections as appropriate. During this part of the connection action at least some of the grease (or other semi-solid medium) in the socket 38 is displaced and passes along the outside of the mandrel 13 to escape into the drill pipe.

The open end of the socket 38 engages the landing surface 49 before the end 13*a* of the mandrel collides with the closed, uphole end of the inside of the socket 38. As a result the energy driving the cable carrier 26 in a downhole direction is transmitted to the shock absorber 14 and attenuated.

The inductively connectable connector pairs achieve connection without contacting one another; and the conductively connectable pairs engage as illustrated. As mentioned this wipes the connectors of each pair, clearing grease, borehole fluid and other non-conducting materials in order to ensure good electrical connection.

The described arrangement gives rise to a reliable connection in which the conductive connector pairs are protected against damage by reason of being located deep inside the socket 38 and by reason of the presence of the semi-sold medium. The inductively connectable connector pairs may as described be protected by shielding on their exteriors, which do not make contact with other parts of the connection and therefore require protection only in respect of the effects of borehole fluid.

A releasable latching mechanism that is not shown in the drawings is then activated to retain the connector parts in their connected configuration. Such a latching mechanism may readily be envisaged by the person of skill in the art, and may be of a type that releases if a threshold tension is exceeded.

Although the described embodiment is a highly reliable design, numerous variants are possible. Thus for example it is not necessary to embody the cable carrier 26 so as to include a socket per se. On the contrary, the mandrel may be caused to pass through one or more guiding rings to ensure it aligns with a cable carrier that may take the form of a plate on one or more surfaces of which the second connectors are supported.

As noted the numbers of the conductively and inductively connectable connectors may vary, it being a requirement herein simply that there is at least one connector of each type.

The mandrel and socket components may be inverted in the arrangement, such that the cable carrier includes a protruding mandrel and the uphole end if the logging tool may include an elongate socket. However in this arrangement it may be hard to be sure an adequate quantity of non-conducting semi-solid medium exists inside the socket.

As explained although the described embodiment is of a logging tool, the downhole tool may take a variety of other forms and may be (or may include) a tester or sampling tool. Combination/hybrid tools also are possible. The person of skill in the art may embody such tools, following as necessary modifications of the parts described and illustrated herein.

The listing or discussion of an apparently prior-published document in this specification should not necessarily be taken as an acknowledgement that the document is part of the state of the art or is common general knowledge.

Preferences and options for a given aspect, feature or parameter of the invention should, unless the context indicates otherwise, be regarded as having been disclosed in combination with any and all preferences and options for all other aspects, features and parameters of the invention.

The invention claimed is:

1. A downhole tool connection comprising:

(i) a tool intended for downhole use and including a connection section protruding therefrom in use in an uphole direction, the connection section supporting two or more first connectors that are spaced from one another and operatively connected to the tool; and (ii) a cable carrier that is moveable in an in-use downhole direction towards the connection section, the cable carrier supporting (a) one or more cables and (b) two or more second connectors that are spaced from one another and operatively connected to at least one of the one or more cables, pairs of the first and second connectors being mutually connectable, on movement of the cable carrier towards the tool connection section so as to increase the proximity of the first and second connectors of the pairs, in a manner effecting electrical transmission between the first and second connectors of each pair, wherein at least one of the pairs of the first and second connectors connects inductively and at least one of the pairs of the first and second connectors connects conductively.

2. A downhole tool connection according to claim 1 wherein the connection section is or includes an elongate mandrel protruding from the in-use uphole end of the tool.

3. A downhole tool connection according to claim 2 including a plurality of the first connectors defining a series extending along the elongate mandrel.

4. A downhole tool connection according to claim 3 wherein at least one of the first connectors of the series that lies nearest the tool connects inductively, and wherein at least one of the first connectors that lies furthest from the tool connects conductively.

5. A downhole tool connection according to claim 4 including a plurality of the first connectors that connect inductively defining a first series extending along the elongate mandrel away from the tool; and a plurality of the first connectors that connect conductively defining a second series extending along the elongate mandrel away from the first series.

6. A downhole tool connection according to claim 5 wherein the first series comprises six of the first connectors; and wherein the second series comprises two of the first connectors.

7. A downhole tool connection according to claim 2 wherein at least one of the first connectors encircles the mandrel.

8. A downhole tool connection according to claim 1 wherein the cable carrier includes one or more socket for receiving the connection section therein.

9. A downhole tool connection according to claim 8 including a semi-solid, essentially non-conducting medium occupying the cross-section of the interior of the socket at least in the vicinity of a given one of the second connectors that connects conductively.

10. A downhole tool connection according to claim 8 wherein the connection section is or includes an elongate mandrel protruding from the in-use uphole end of the tool; and wherein the socket is or includes an elongate hollow cylinder.

11. A downhole tool connection according to claim 10 wherein at least one of the second connectors includes an annulus extending about the interior of the hollow cylinder.

12. A downhole tool connection according to claim 11 wherein the connection section is or includes an elongate mandrel protruding from the in-use uphole end of the tool; wherein at least one of the first connectors encircles the mandrel; and wherein the diameter of the at least one second connector including the annulus extending about the interior of the hollow cylinder that connects inductively is greater than the outer diameter of the at least one first connector of the pair of which the at least one second connector forms part.

13. A downhole tool connection according to claim 11 wherein the connection section is or includes an elongate mandrel protruding from the in-use uphole end of the tool; wherein at least one of the first connectors encircles the mandrel; and wherein the diameter of the at least one second connector including the annulus extending about the interior of the hollow cylinder that connects conductively results in contact with the at least one first connector of the pair of which the at least one second connector forms part when the at least one first and second connectors are in proximity.

14. A downhole tool connection according to claim 8 including a plurality of the second connectors defining a series extending along the interior of the socket.

15. A downhole tool connection according to claim 14 wherein at least one of the second connectors of the series that in use lies nearest the tool connects inductively, and wherein at least one of the second connectors that lies furthest from the tool connects conductively.

16. A downhole tool connection according to claim 15 including a plurality of the second connectors that connect inductively defining a third series extending in use along the interior of the socket away from the tool; and a plurality of the second connectors that connect conductively defining a fourth series extending along the interior of the socket away from the first series.

17. A downhole tool connection according to claim 1 wherein the cable carrier includes an elongate, cylindrical body supporting on its exterior one or more swab cups permitting pumping of the cable carrier along a borehole.

18. A downhole tool connection according to claim 1 wherein the cable carrier includes an elongate, hollow cylindrical body inside which at least one of the one or more cables supported by the cable carrier extends.

19. A downhole tool connection according to claim 18 including one or more flexible weights supporting at least one of the one or more cables inside the cylindrical body.

20. A downhole tool connection according to claim 1 wherein at least one of the one or more cables supported by the cable carrier in use connects to one or more sources of electrical power located uphole of the tool.

21. A downhole tool connection according to claim 1 wherein at least one of the one or more cables supported by the cable carrier that connects to the second connector that connects inductively is connected to one or more sources of electrical power in a range of 8-15 Watts each.

22. A downhole tool connection according to claim 1 wherein at least one of the one or more cables supported by the cable carrier that connects to the second connector that connects conductively is connected to one or more sources of at least 200 Watts of electrical power.

23. A downhole tool connection according to claim 1 wherein the cable carrier is or includes a side entry cable sub.

24. A downhole tool connection according to claim 1 including one or more shock absorber acting between the connection section and the tool.

25. A downhole tool connection according to claim 24 wherein the shock absorber includes one or more resiliently deformable member defining an elongate column, whereby the column is resiliently compressible on being subjected to compressive force in the direction of elongation of the column.

26. A downhole tool connection according to claim 24 wherein the resiliently deformable member is formed as two or more regions of the material or materials of the column that are interconnected by resiliently deformable interconnecting elements.

27. A downhole tool connection according to claim 26 wherein at least one of the resiliently deformable interconnecting elements is formed from the material or materials of the column.

28. A downhole tool connection according to claim 24 wherein the shock absorber includes at an in-use uphole end one or more landing surfaces from which the connection section protrudes in a manner exposing part of the landing surface for engagement by the cable carrier on movement of the cable carrier towards the tool connection section so as to increase the proximity of the first and second connectors of the pairs.

29. A downhole tool connection according to claim 1 wherein the connection section includes a cylindrical body that includes one or more fluid flow passage extending therethrough and defining a fluid flow path.

30. A downhole tool connection according to claim 29 wherein the fluid flow path includes one or more openable and closeable valves for opening and closing the fluid flow path.

31. A downhole tool connection according to claim 1 when included in or forming part of a downhole tool selected from the list including logging tools, testers, and sampling tools.

* * * * *